US006139262A

United States Patent [19]

Ravidranath

[11] Patent Number: 6,139,262

[45] Date of Patent: Oct. 31, 2000

[54] VARIABLE GEOMETRY DIFFUSER

[75] Inventor: Ravi A. Ravidranath, Lancaster, Pa.

[73] Assignee: York International Corporation, York, Pa.

[21] Appl. No.: 09/074,584

[22] Filed: May 8, 1998

[51] Int. Cl.[7] ..... F04D 27/00

[52] U.S. Cl. ..... 415/150; 415/148; 415/126; 415/211.2; 415/150

[58] Field of Search ..... 415/146, 148, 415/150, 149.1, 126, 127, 170.1, 174.1, 211.2

[56] References Cited

U.S. PATENT DOCUMENTS

| | | | |
|---|---|---|---|
| 2,285,976 | 6/1942 | Huitson . | |
| 3,289,919 | 12/1966 | Wood . | |
| 4,257,733 | 3/1981 | Bandukwalla et al. | 415/13 |
| 4,378,194 | 3/1983 | Bandukwalla | 415/49 |
| 4,416,583 | 11/1983 | Byrns | 415/148 |
| 4,460,310 | 7/1984 | Plunkett | 415/26 |
| 4,844,690 | 7/1989 | DeLaurier et al. | 415/148 |
| 5,116,197 | 5/1992 | Snell . | |
| 5,207,559 | 5/1993 | Clevenger et al. | 415/166 |

FOREIGN PATENT DOCUMENTS

| | | |
|---|---|---|
| 0 402 870 A1 | 12/1990 | European Pat. Off. . |
| 1 428 192 | 3/1962 | Germany . |

*Primary Examiner*—Edward K. Look
*Assistant Examiner*—Mathew T. Shanley
*Attorney, Agent, or Firm*—Finnegan, Henderson, Farabow, Garrett & Dunner, L.L.P.

[57] ABSTRACT

A system for a variable capacity centrifugal compressor is provided. The compressor includes a base plate, a housing, and a variable geometry diffuser. A selectively moveable wall is disposed adjacent the base plate to vary the geometry of the diffuser. A portion of the moveable wall cooperates with a portion of the base plate to restrict the flow of fluid between the moveable wall and the base plate throughout the range of motion of the moveable wall to reduce the force required to open the diffuser.

25 Claims, 9 Drawing Sheets

VARIABLE GEOMETRY DIFFUSER

BACKGROUND OF THE INVENTION

The present invention relates to centrifugal compressors, and more particularly, to an improved variable geometry diffuser for a variable capacity centrifugal compressor.

Centrifugal compressors are useful in a variety of devices that require a fluid to be compressed. The devices include, for example, turbines, pumps, and chillers. The compressors operate by passing the fluid over a rotating impeller. The impeller works on the fluid to increase the pressure of the fluid. Because the operation of the impeller creates an adverse pressure gradient in the flow, many compressor designs include a diffuser positioned at the impeller exit to stabilize the fluid flow.

It is often desirable to vary the amount of fluid flowing through the compressor or the pressure differential created by the compressor. However, when the flow of fluid through the compressor is decreased, and the same pressure differential is maintained across the impeller, the fluid flow through the compressor often becomes unsteady. Some of the fluid stalls within the compressor and pockets of stalled fluid start to rotate with the impeller. These stalled pockets of fluid are problematic in that they create noise, cause vibration, and reduce the efficiency of the compressor. This condition is known as rotating stall or incipient surge. If the fluid flow is further decreased, the fluid flow will become even more unstable, in many cases causing complete reversals of fluid flow. This phenomenon, known as surge, is characterized by fluid alternately surging backward and forward through the compressor. In addition to creating noise, causing vibration, and lowering compressor efficiency, fluid surge also creates pressure spikes and can damage the compressor.

A solution to the problems created by stall and surge is to vary the geometry of the diffuser at the exit of the impeller. When operating at a low fluid flow rate, the geometry of the diffuser can be narrowed to decrease the area at the impeller exit. The decreased area will prevent the fluid stalling and ultimately surging back through the impeller. When the fluid flow rate is increased, the geometry of the diffuser can be widened to provide a larger area for the additional flow. The variable geometry diffuser can also be adjusted when the pressure differential created by the compressor is changed. When the pressure differential is increased, the geometry of the diffuser can be narrowed to decrease the area at the impeller exit to prevent fluid stall and surge. Similarly, when the pressure differential is decreased, the geometry of the diffuser can be widened to provide a larger area at the impeller exit.

Several devices for varying the geometry of the diffuser are disclosed in the prior art. For example, U.S. Pat. No. 5,116,197 to Snell discloses a variable geometry diffuser for a variable capacity compressor. This device, and others like it, include a moveable ring that may be selectively adjusted to vary the geometry of the diffuser at the impeller exit. The ring is positioned adjacent to one wall of the diffuser and can be moved out into the flow of fluid to decrease the area of the diffuser to account for a lower fluid flow or an increased pressure differential.

However, when the ring is positioned in the fluid flow, the known devices create an opening between the ring and the wall into which fluid exiting the impeller will flow. When attempting to move the ring out of the fluid flow, the fluid must be cleared from between the ring and wall. Displacing this fluid so the ring can be moved requires a significant amount of force, since the fluid acts to oppose the motion of the wall.

In light of the foregoing there is a need for a variable geometry diffuser for a variable capacity compressor that may be easily opened and closed during the operation of the compressor.

SUMMARY OF THE INVENTION

Accordingly, the present invention is directed to a variable geometry diffuser that obviates one or more of the limitations and disadvantages of prior art variable geometry diffusers. The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention, as embodied and broadly described herein, the invention is directed to a system for a variable capacity centrifugal compressor for compressing a fluid. The compressor includes an impeller rotatably mounted in a housing. The system includes a base plate fixed to the housing adjacent the impeller. The base plate has an elongated surface that cooperates with an opposed interior surface on the housing to define an outlet flow path. A wall, selectively moveable between an open and a closed position, is disposed on the base plate. The moveable wall has a diffuser surface disposed opposite the interior surface on the housing to define a diffuser between the impeller and the outlet flow path. A portion of the moveable wall cooperates with a portion of the base plate to restrict the flow of fluid between the moveable wall and the base plate throughout the range of movement of the moveable wall from the open position, where the diffuser is maximized, to the closed position, where the diffuser is minimized.

In another aspect, the present invention is directed to a centrifugal compressor for compressing a fluid. The moveable wall of this aspect of the invention forms a ring.

In another aspect, the invention is directed to a system for a centrifugal compressor for compressing a fluid. The system includes a means for restricting the flow of fluid between the moveable wall and the base plate when the wall is moved between the open and closed positions.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DETAILED DESCRIPTION

Reference will now be made in detail to the presently preferred embodiments of the invention, examples of which are illustrated in the accompanying drawings. Wherever possible, the same reference numbers will be used throughout the drawings to refer to the same or like parts.

In accordance with the present invention, a system for a variable capacity centrifugal compressor is provided. The compressor includes an impeller rotatably mounted on a housing. A base plate is fixed to the housing adjacent the impeller. The base plate has an elongated surface that cooperates with an opposed interior surface on the housing to define an outlet flow path. An exemplary variable capacity centrifugal compressor is shown in FIG. 1 and is designated generally by reference number 20.

The system of the present invention is an improvement upon existing variable geometry diffusers for variable capacity compressors. An example of a structure used to vary the geometry of a diffuser is disclosed in U.S. Pat. No. 5,116,197, which is hereby incorporated by reference. While the presently preferred embodiment of the present invention is applied to a variable capacity compressor of the type described in U.S. Pat. No. 5,116,197, it is contemplated that the present invention may be used in connection with any variable geometry diffuser for a variable capacity centrifugal compressor known or readily apparent to one skilled in the art.

Figure 1:
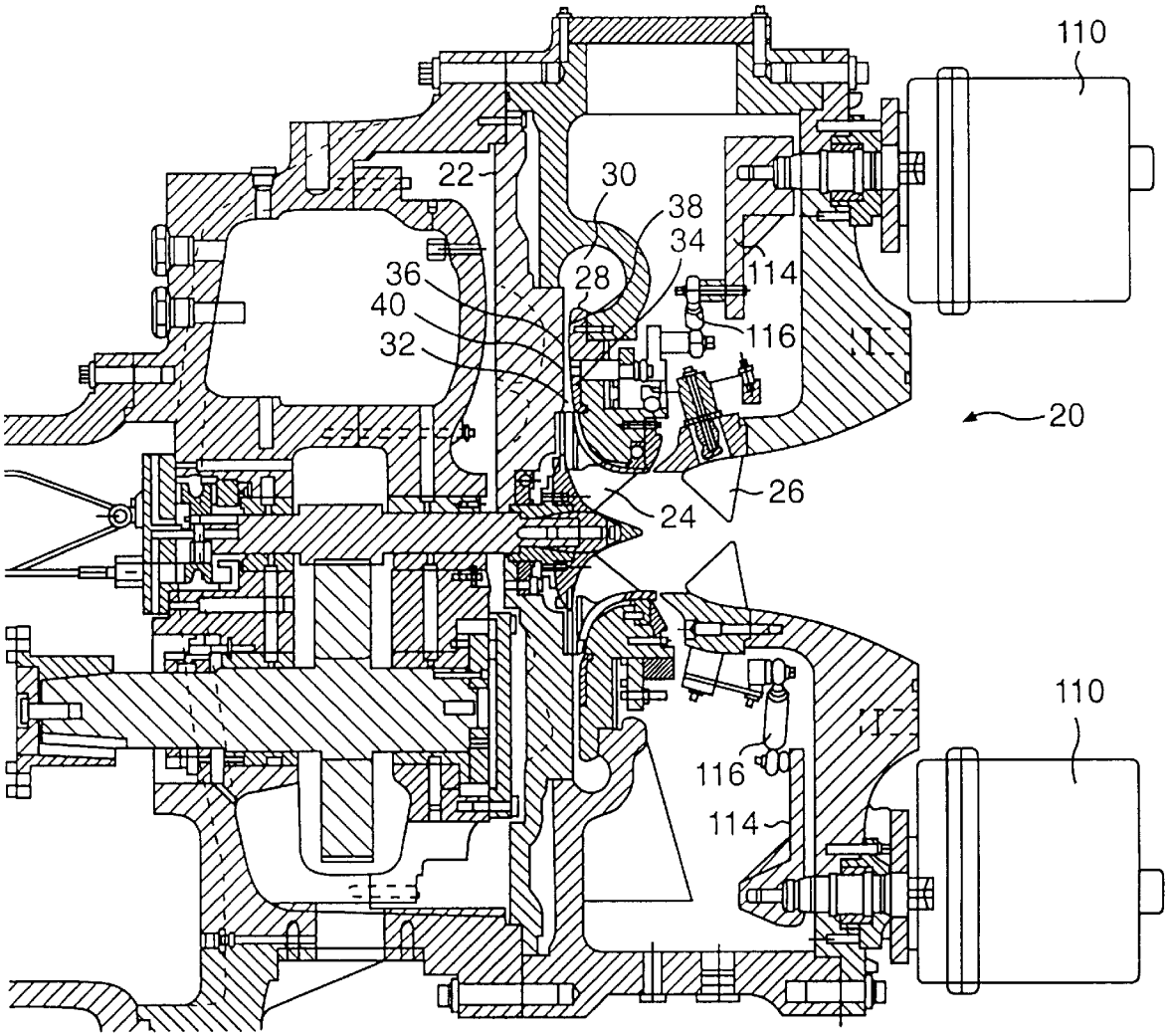
FIG. 1 is a section view of a compressor illustrating a preferred embodiment of the present invention.

As illustrated in FIG. 1, variable capacity centrifugal compressor 20 includes a housing 22, an impeller 24, inlet vanes 26, a base plate 28, a diffuser 32, and a volute 30. Impeller 24 is rotatably mounted on housing 22. Base plate 28 is fixed to housing 22 adjacent impeller 24. Base plate 28 has an elongated surface 38 that aligns with an interior wall 40 of housing 22 to define an outlet flow path 36.

The flow of fluid entering the compressor is controlled by inlet vanes 26. Inlet vanes 26 have actuators which rotate inlet vanes 26 to adjust the flow of fluid through the compressor. The vanes may be opened to increase the fluid flow or closed to decrease the flow of fluid. In this manner, the capacity of the compressor may be changed. In one preferred embodiment of the present invention, a device capable of determining the relative position of vanes is connected to the inlet vanes actuators so that the amount of flow through the compressor is known.

After passing inlet vanes 26, fluid flows over rotating impeller 24. Impeller 24 works the fluid to increase the pressure of the fluid. Many types and shapes of impellers are known in the art. The present invention contemplates the use of any impeller. The fluid exits the impeller through diffuser 32 and flows through outlet flow path 36 to volute 30.

In accordance with the present invention, a moveable wall is provided. The moveable wall of the preferred embodiment is disposed on the base plate and is selectively moveable relative to the base plate. The wall has a diffuser surface disposed opposite the interior surface of the housing to define a diffuser. The wall is moveable between an open position where the diffuser is maximized and a closed position where the diffuser is minimized. The wall can be selectively moved to any position within the range. A portion of the moveable wall cooperates with a portion of the base plate to restrict the flow of fluid between the moveable wall and the base plate throughout the range of movement of the moveable wall from the open to the closed positions.

Figure 2:
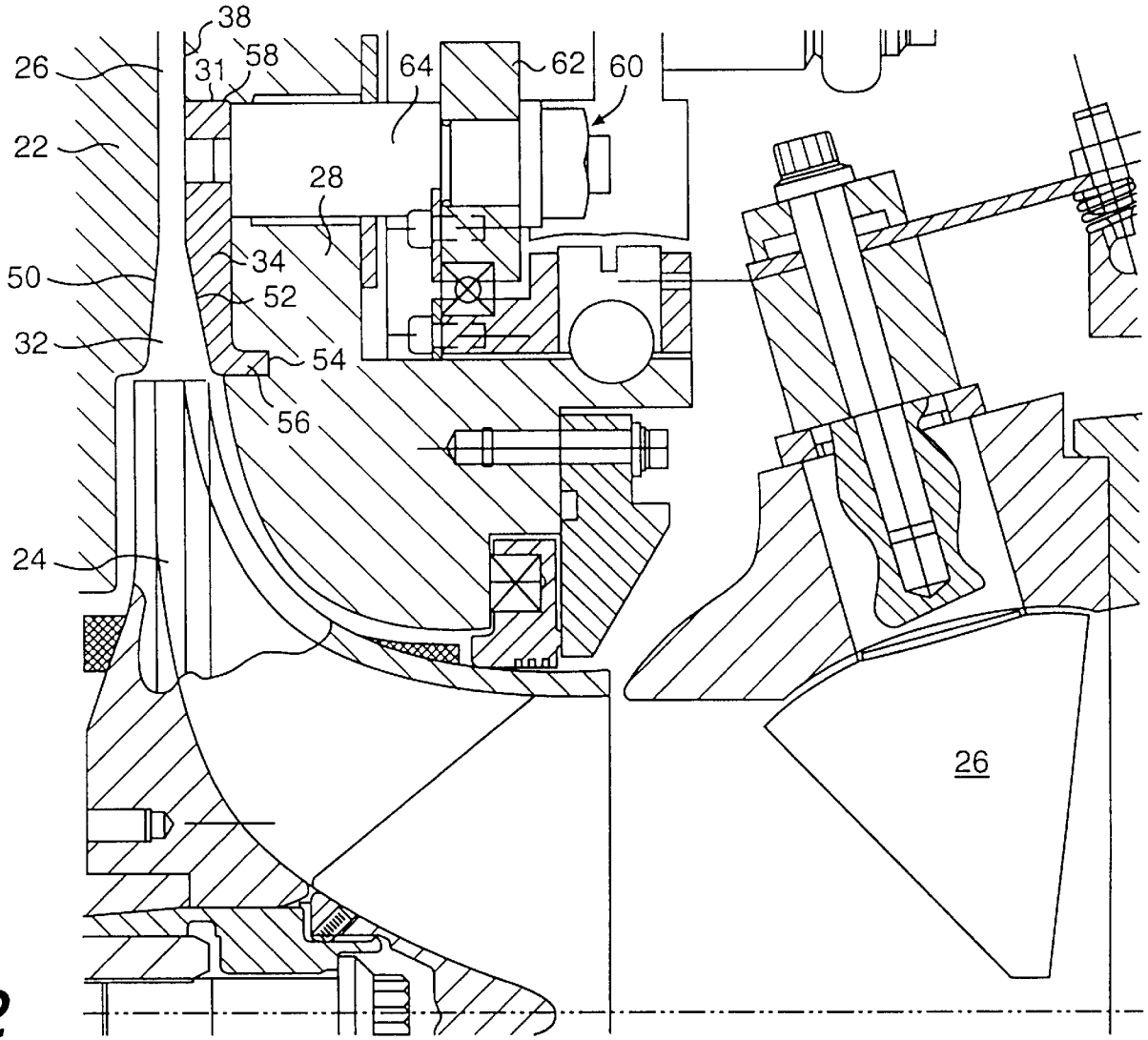
FIG. 2 is an enlarged cross-sectional view of the variable geometry diffuser of FIG. 1.

As embodied herein, and as illustrated in FIG. 2, a moveable wall 34 is positioned adjacent base plate 28. Wall 34 forms an annular ring positioned adjacent the exit of impeller 24. Wall 34 is preferably made from any suitable metal or alloy, for example aluminum, iron, or steel. In one preferred embodiment of the invention, the width of wall 34 increases along diffuser 32. The increased width of the moveable wall decreases the area of the flow path, thereby causing an additional pressure increase in the fluid. The present invention contemplates embodiments where the width of the wall remains constant as well.

The wall 34 has a diffuser surface 52 disposed opposite an interior surface 40 of housing 22. Diffuser surface 52 and interior surface 40 define the diffuser 32. In the embodiment shown in FIGS. 1, 2, and 3, wall 34 also has a flange 56 projecting towards base plate 28. In the preferred embodiment, flange 56 has a generally rectangular shape. Base plate 28 has a recess 54 configured to receive flange 56.

Figure 3A:
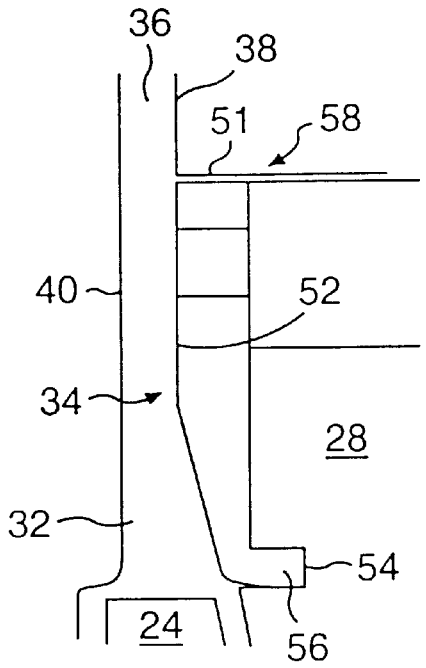
FIG. 3*a* is a side view of the moveable wall of the present invention, illustrating the open position.

As shown in FIG. 3*a,* when wall 34 is in the open position, where the size of diffuser 32 is maximized, all three sides of flange 56 are positioned closely with the corresponding surfaces of recess 54. The sides of flange 56 and the corresponding surfaces of recess 54 are preferably sufficiently close to each to form a labyrinth seal between flange 56 and base plate 28. The seal restricts fluid from flowing between wall 34 and base plate 28. Such a seal can be alternatively created by forming a recess in the wall and a corresponding flange on the base plate.

Figure 3B:
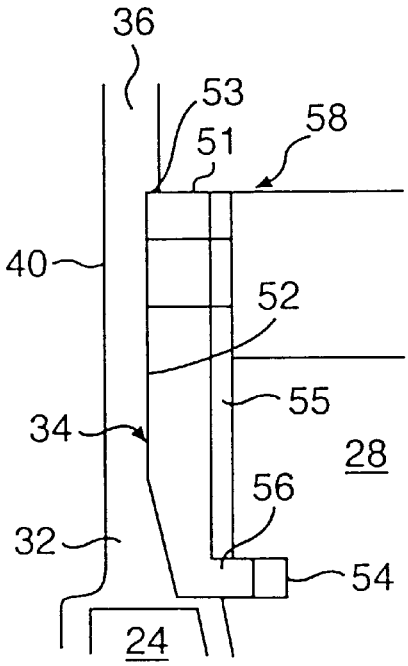
FIG. 3*b* is a side view of the moveable wall of FIG. 3*b,* illustrating a more closed position.

As shown in FIG. 3*b,* when wall 34 is in the closed position, where the size of diffuser 32 is minimized, an opening 55 is formed between wall 34 and base plate 28. Two sides of flange 56 remain positioned in close proximity to recess 54. The close proximity of these surfaces maintains the seal to restrict fluid from flowing into opening 55 between wall 34 and base plate 28.

Base plate 28 has a recess 58 configured to receive wall 34. When wall 34 is in an open position, as illustrated in FIG. 3*a,* diffuser surface 52 aligns with a surface 38 of base plate 28. Wall 51 of recess 58 is sized based on the length of flange 56. When the wall is moved to the closed position, as illustrated in FIG. 3*b,* outer end 53 of wall 34 remains in close proximity to wall 51 of recess 58 to restrict fluid from flowing into opening 55 between wall 34 and base plate 28.

Figure 4:
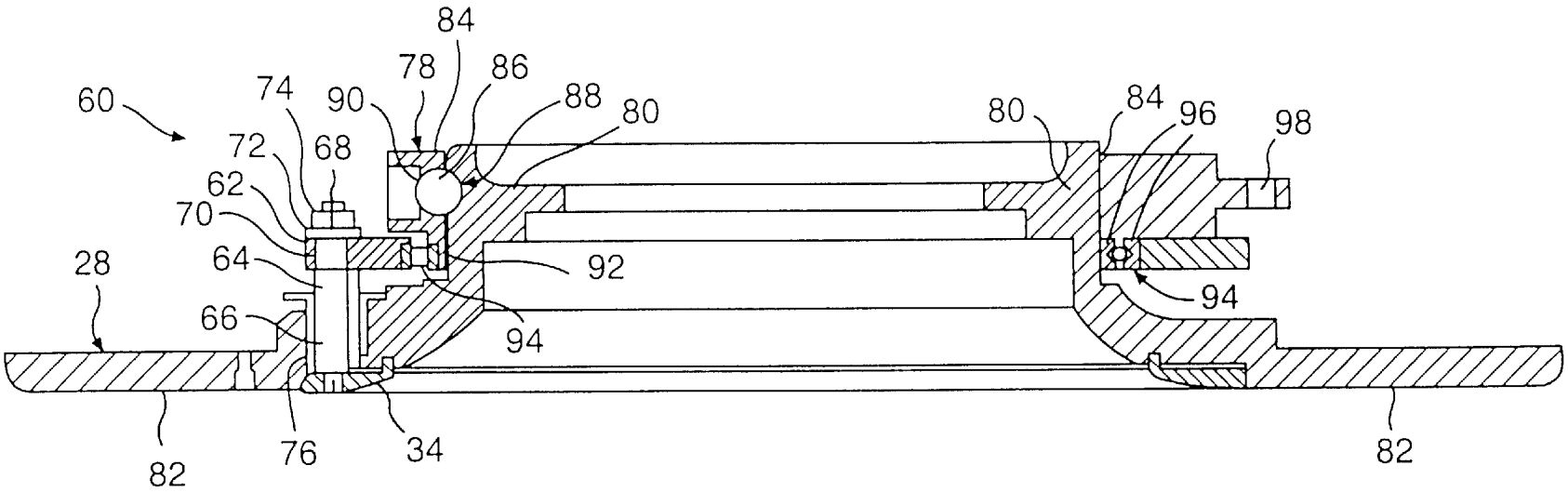
FIG. 4 is a side cross-sectional view of the support structure of a preferred embodiment of the present invention.

As illustrated in FIG. 2, wall 34 is connected to a support structure 60 for moving wall 34. As shown in FIG. 4, support structure 60 includes an annular push ring 62 and a plurality of pins 64 that connect the annular push ring 62 to the moveable wall 34. Preferably, six pins 64 are equidistantly spaced about the annular push ring 62. Pins 64 have sliding portions 66 and threaded portions 68. Sliding portions 66 of pins 64 can be ground and chrome plated to increase smoothness.

Threaded portions 68 of pins 64 are inserted in holes 70 in annular push ring 62. Washers 72 are placed on threaded portions 68 and nuts 74 are tightened along threaded portions 68 to fix pins 64 to the annular push ring 62. Pins 64 extend through holes 76 in base plate 28 and are fixedly connected to the movable wall 34 by conventional means. For example, the pins can be bolted, welded, or brazed into the ring. In the preferred embodiment, pins 64 are fixedly connected to movable wall 34 by a threaded portion on the pins 64 that threads into threads cut into threaded holes in the annular push ring 62. Because pins 64 extend through the holes 76 in base plate 28 and because base plate 28 is fixed to compressor housing 22, pins 64 prevent rotational movement of the annular push ring 62.

In a preferred embodiment, sleeves 76, which advantageously are self-lubricating, are inserted into holes 76 in base plate 28. These sleeves 76 are sized to create a seal between the pins 64 and nozzle base plate 28. The sleeves 76 may, for example, be formed from polytetrafluoroethylene, sold under the trademark TEFLON, or carbon impregnated nylon. The use of such sleeves 76 eliminates the need for any direct lubrication of the pins 64.

As embodied herein, support structure 60 also includes a drive ring 78 to drive annular push ring 62. Drive ring 78 is mounted on a projecting portion of base plate 28, preferably via a ball bearing arrangement. Base plate 28 is generally annular in shape and is fixed to the outer housing of the compressor by conventional means. Base plate 28 includes a generally projecting portion 80 which extends axially away from a base portion 82 of base plate 28. Projecting portion 80 includes a generally cylindrical outer surface 84 onto which annular drive ring 78 is mounted.

Figure 5:
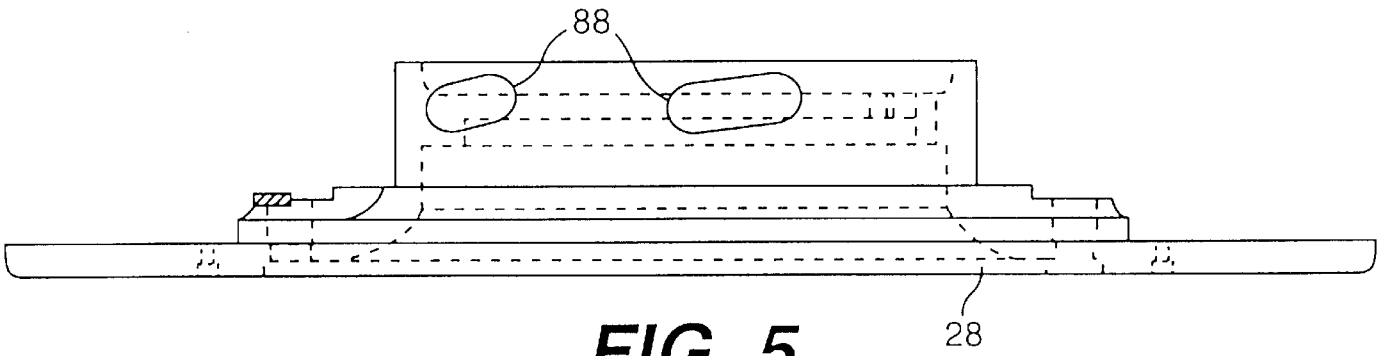
FIG. 5 is a side view of the support structure of FIG. 4.

The preferred ball bearing arrangement used to rotatably connect the drive ring 78 to nozzle base plate 28 includes balls 86 which ride in special tracks or races 88 machined into the cylindrical outer surface 84 of base plate 28. As best shown in FIG. 5, these races 88 are machined in a screw thread like pattern about the centerline of the compressor 20. As shown in FIG. 4, balls 86 also ride in spherical pockets 90 spaced equidistantly about the inside diameter of the drive ring 78. The number of races 88 corresponds to the number of spherical pockets 90 and balls 86.

When drive ring 78 is mounted onto the cylindrical outer surface 84 of the base plate 28, base plate 28 and drive ring 78 have a common axis, and the drive ring 78 is positioned radially outward of the cylindrical outer surface 84. When the drive ring 78 is rotated relative to base plate 28 and about the centerline of the compressor 20, it advances axially because of the movement of balls 86 in races 88. Drive ring 78 moves in the axial direction until balls 86 contact the ends of races 88. Thus, the ball bearing arrangement allows for a slidable connection between the drive ring 78 and base plate 28 which converts rotational movement of the drive ring 78 into axial movement.

Drive ring 78 is slidably interconnected to annular push ring 62 so that the axial movement of the drive ring 78 upon rotation can be translated to annular push ring 62. Drive ring 78 includes an inwardly extending annular flange 92 that is positioned radially inside annular push ring 62. In the preferred embodiment, drive ring 78 and annular push ring 62 are interconnected by a bearing 94. As shown, bearing 94 is positioned on the outer circumference of drive ring 78 and on the inner circumference of annular push ring 62.

Figure 6:
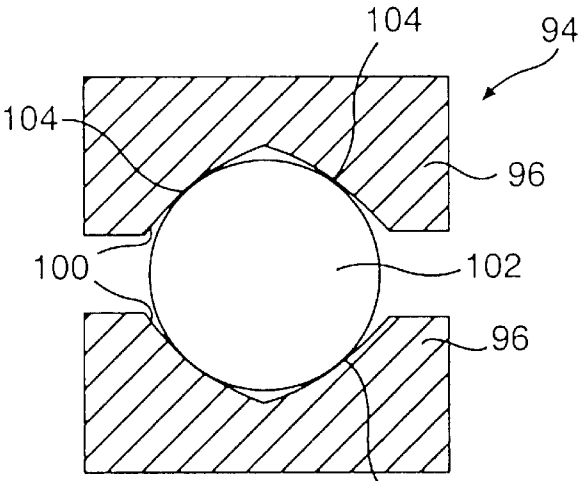
FIG. 6 is a partial section view of a bearing used in an embodiment of the support structure of FIG. 4.

As shown in FIG. 6, bearing 94 has two races 96, one of which is fixed to drive ring 78 and the other of which is fixed to annular push ring 62. The running surfaces 100 of races 96 preferably have a cross sectional shape similar to a gothic arch. The gothic arch shape causes the balls 102 to have two points of contact 104 with each of the races 96. This structure allows bearing 50 to operate while subjected to force in both the radial and axial directions. This arrangement allows drive ring 78 and annular push ring 62 to rotate relative to each other while, simultaneously, preventing drive ring 78 and annular push ring 62 from moving axially relative to each other.

Figure 7:
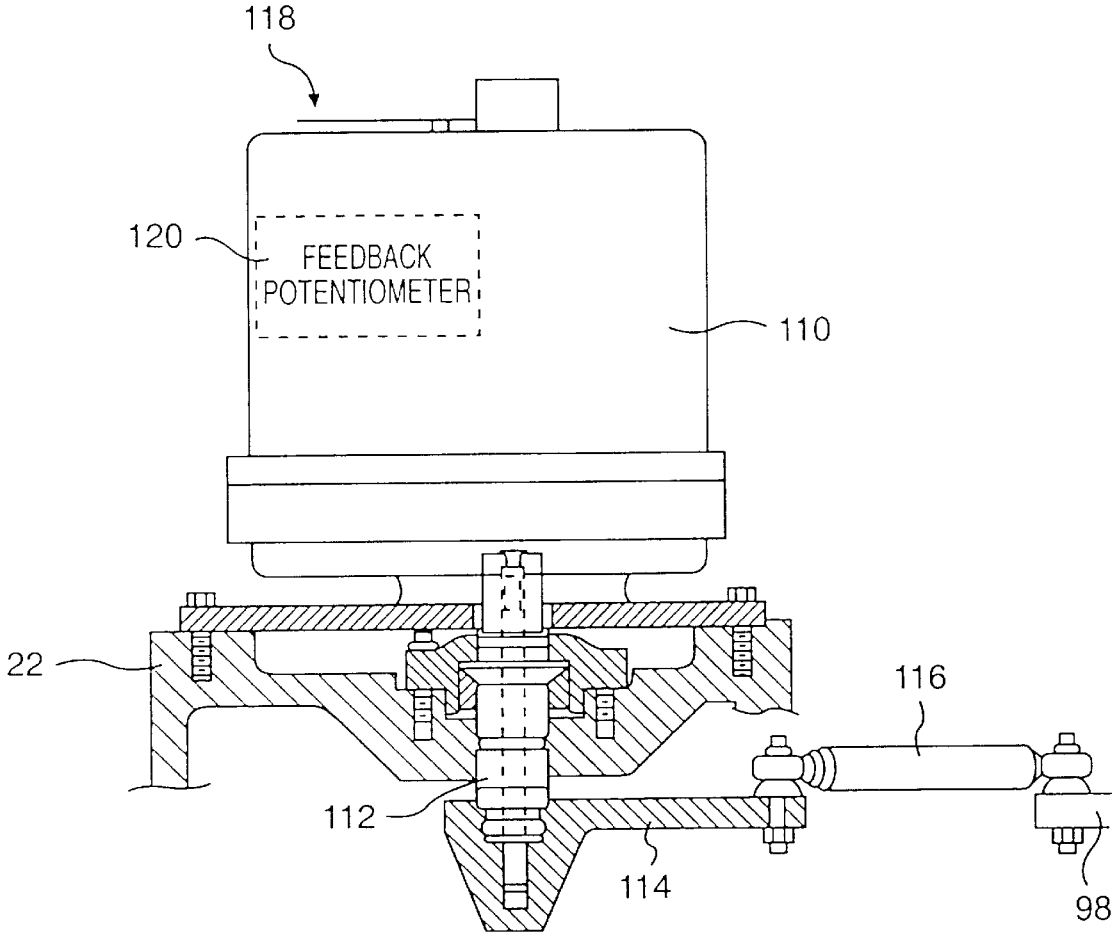
FIG. 7 is a partial section view of an actuator assembly used in an embodiment of the invention.

In a preferred embodiment, drive ring 78 is driven by an actuator. As illustrated in FIG. 7, actuator assembly 118 includes a control shaft 112, a lever arm 114, an adjustable link 116, and a knuckle 98 located on drive ring 78. One end of control shaft 112 extends outside of the compressor housing 22. The other end of control shaft 112 is connected to lever arm 114. Lever arm 114 is connected to adjustable link 116, which is connected to knuckle 98 on drive ring 78. Rotation of control shaft 112 causes rotation of the drive ring 78 via the lever arm 114 and the adjustable link 116.

Rotation may be imparted to control shaft 112 with an electric motor or a piston device. Alternatively, the piston device could be directly connected to drive ring 78 to cause rotational movement thereof. In the preferred embodiment, shown in the drawings, control shaft 112 is connected to a direct drive electrically operated actuator 110. The actuator 110 has a feedback potentiometer 120 which operates as a position sensor. Feedback potentiometer 120 indicates the position of the actuator 110 and the position of the movable wall 34 can be determined from that information. Alternatively, the position sensor may be located in the actuator 110.

A preferred embodiment of the invention can also include an electronic control device for controlling the axial position of the movable wall 34 depending upon the rate of flow of fluid through the compressor. The controlling device, which could, for example, constitute a microprocessor, determines the desired position of the movable wall 34. The control device receives a signal from the position sensor of the inlet vane actuators that identifies the position of the inlet vanes 24. The control device can then determine the amount of flow through the system and identify the optimal position of moveable wall 34 to prevent stall or surge from occurring in the compressor. The control device then sends a signal to actuator 110 to cause the movable wall 34 to be moved into the proper position. Actuator 110 rotates control shaft 112 until the position sensor of actuator 110 indicates that the optimal wall position has been reached.

The operation of the aforementioned device will now be described with reference to the attached drawings. As the compressor load decreases, the inlet vanes 24 will rotate to decrease the flow of fluid entering the compressor. The position sensor connected to the inlet vanes actuators indicates the position of the inlet vanes 24. The electronic control device senses the position of the vanes, determines the corresponding proper position for the movable wall 34, and transmits a control signal to the actuator 110. Actuator 110 imparts rotational movement to control shaft 112. Control shaft 112 moves lever arm 114 which causes a corresponding rotational movement of the drive ring 78. Rotation of drive ring 78 causes balls 86 to move in races 88 on base plate 28. The movement of balls 86 in races 88 causes balls 88 and the drive ring 78 to move axially. As drive ring 78 rotates and moves axially, annular push ring 62 will remain rotatably fixed due to the pins 64, but will move axially along with the drive ring 78. Pins 64 will transfer the axial movement of annular push ring 62 to movable wall 34. The rotational movement of actuator 110 is continued until the positioning sensor indicates that the moveable wall 34 has achieved the desired position.

As illustrated in FIGS. 3*a* and 3*b*, flange 56 is engaged with recess 54 throughout the movement of wall 34. The flange 56 and associated recess cooperate to minimize and preferably prevent fluid from entering opening 55 between wall 34 and base plate 28. Outer wall 53 of the moveable wall 34 is also in close proximity to wall 51 of base plate 28 to similarly minimize or prevent flow of fluid into opening 55. Thus, when the fluid flow through the compressor is increased and the diffuser 32 must be opened to compensate for the increase in fluid flow, the moveable wall will not encounter resistance of fluid as it moves to the open position. Thus, the force required to open the diffuser is significantly reduced. In the disclosed embodiment, the force is produced by rotating control shaft 112. Thus, the torque required from actuator 110 will be less to move the wall to the open position and maximize diffuser 32.

In addition to reducing the force required to vary the geometry of the diffuser, the present invention will also improve the efficiency of known variable capacity compressors. Because fluid does not flow between the moveable wall and the base plate, the flow through the compressor is not significantly disrupted when the wall is moved. Thus, the fluid moves steadily through the compressor and the overall efficiency is improved.

The present invention contemplates the use of other embodiments to inhibit the flow of fluid between the moveable wall and base plate throughout the range of motion of the moveable wall. In the embodiment illustrated in FIG. 8, a second flange 130 is disposed on moveable wall 34. Second flange 130 projects towards base plate 28. Both flanges 56 and 130 are spaced away from edges 134 and 136, respectively, of wall 34. A second recess 132 is disposed on base plate 28. Second recess 132 is configured to receive second flange 130. The engagement of second flange 130 with second recess 132 operates to inhibit flow between wall 34 and base plate 28 in the same manner as described previously.

In this embodiment, moveable wall 34 and base plate 28 cooperate to form several restrictions to minimize or prevent fluid flow behind moveable wall 34. First, the inner side wall 134 of moveable wall 34 cooperates with an opposing wall 133 on base plate 28 formed by the recess into which the moveable wall fits. Second, the flange 56 and the walls of recess 54 form a restriction or seal. Third, the outer side wall 136 of the moveable wall 34 cooperates with the opposing wall 135 on the base plate 28 formed by the recess into which the moveable wall fits. Fourth, the flange 136 and the walls of recess 132 form a restriction or seal.

Figure 8:
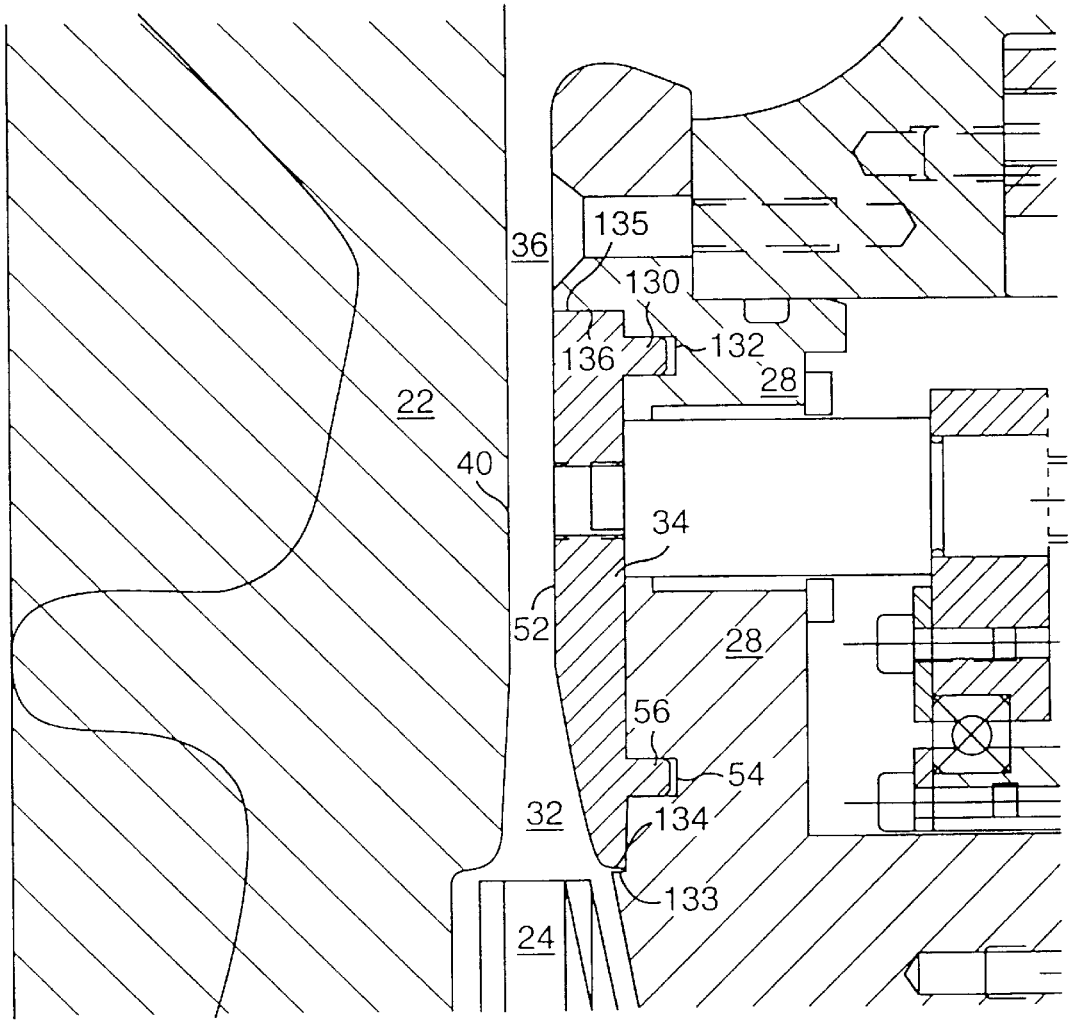
FIG. 8 is a side view of another embodiment of the moveable wall and base plate of the present invention.
Figure 9:
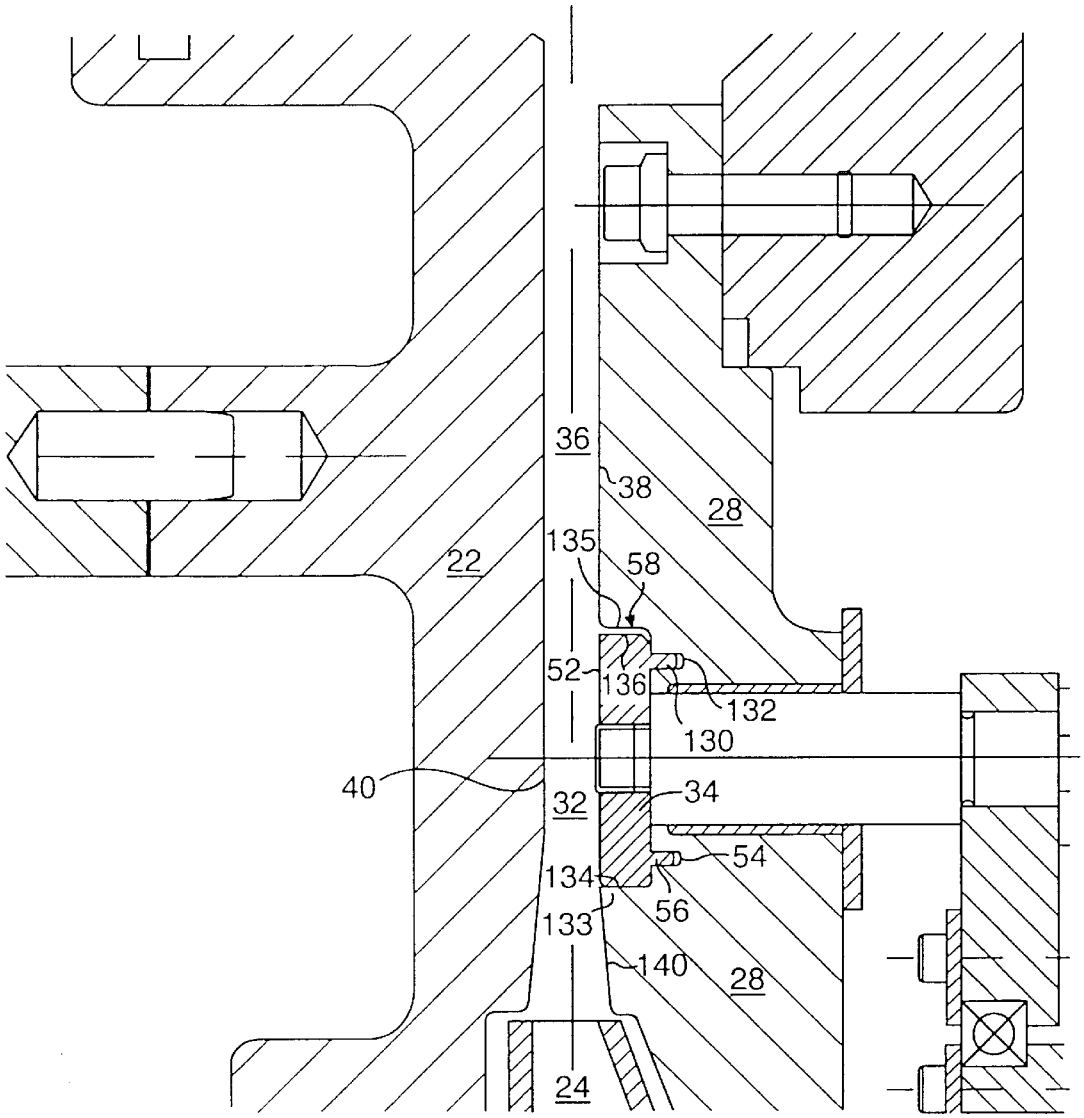
FIG. 9 is a side view of a third embodiment of the moveable wall and base plate of the present invention.

In the embodiment illustrated in FIG. 9, a surface 140 of base plate 28 separates diffuser 32 from impeller 24. The width of wall 34 is constant along the diffuser 32. Recess 58 in base plate 28 is configured to closely receive wall 34 such that diffuser surface 52 aligns with base plate surface 38. This embodiment is similar to that of FIG. 8 but includes a more pronounced or elongated restriction between the inner wall 134 of the moveable wall 34 and the opposing wall 133 of base plate 28. First and second flanges 56 and 130 engage first and second recesses 54 and 132 in this embodiment to inhibit flow between wall 34 and base plate 28 to inhibit flow between wall 34 and base plate 28 in the same manner described previously.

Figure 10:
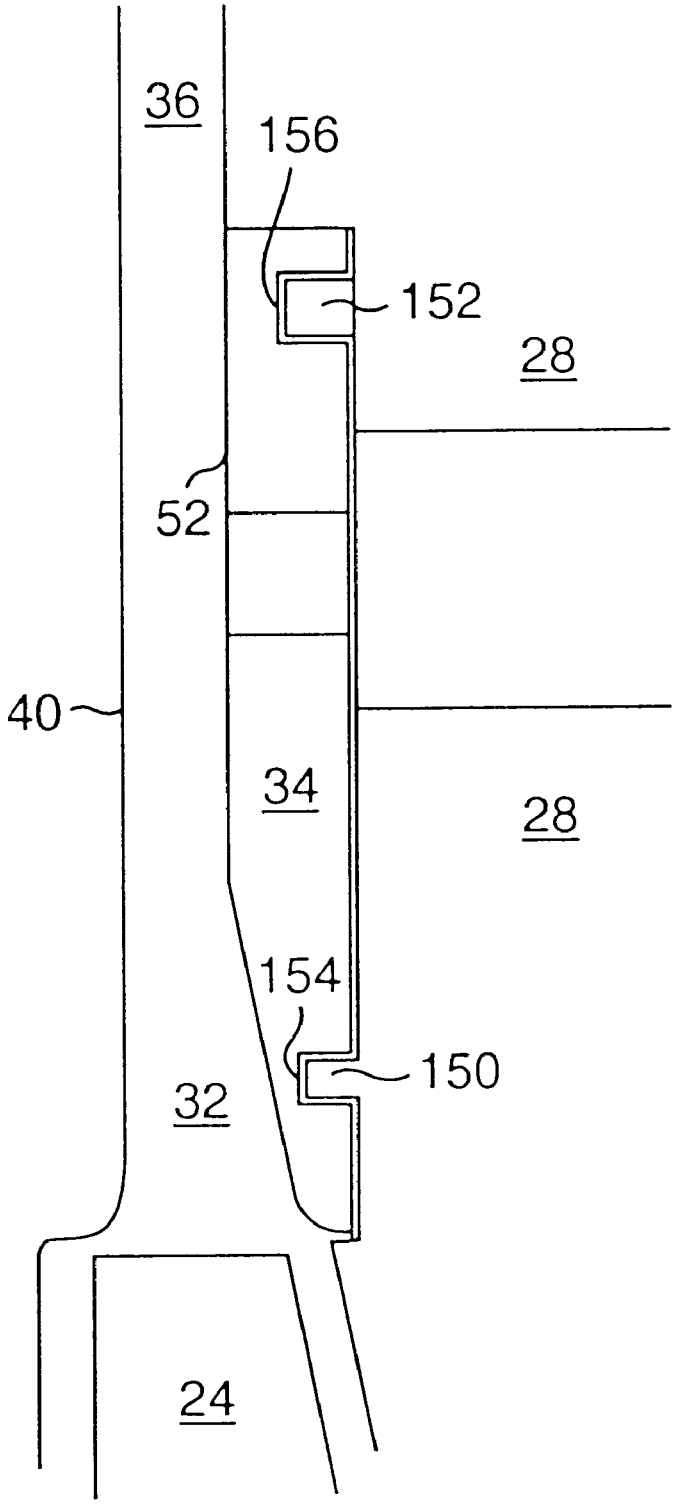
FIG. 10 is a side view of a fourth embodiment of the movable wall and base plate of the present invention.

The embodiment illustrated in FIG. 10 is similar to the embodiment illustrated in FIG. 8, except that the flanges are formed on the base plate, not the wall. As shown, a first and second flange 150 and 152, respectively, are disposed on base plate 28 and project towards wall 34. Wall 34 has a first and second recess 154 and 156 configured to receive and engage first and second flanges 150 and 152. The close proximity of the surfaces of the flanges and recesses operate to create a seal between the flanges and recesses in the manner previously explained. The seal operates to prevent fluid from flowing between wall 34 and base plate 28 when the wall 34 is moved from the open position. Because no fluid flows between wall 34 and base plate 28, less force is required to move wall 34 to an open position and maximize diffuser 32.

It will be apparent to those skilled in the art that various modifications and variations can be made in the construction of this variable geometry diffuser without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed:

1. A system for a variable capacity centrifugal compressor for compressing a fluid, the compressor having a housing and an impeller, the impeller being rotatably mounted in the housing, the system comprising:

a base plate fixed to the housing adjacent the impeller, the base plate having an elongated surface that cooperates with an opposed interior surface on the housing to define an outlet flow path;

a moveable wall disposed on the base plate and selectively moveable relative to the base plate, the wall having a diffuser surface disposed opposite the interior surface on the housing to define a diffuser positioned between the impeller and the outlet flow path, the wall being movable between an open position where the diffuser is maximized to a closed position where the diffuser is minimized;

wherein a flange projects outwardly from one of the moveable wall or the base plate toward a recess configured to receive the flange in the other, the flange cooperating with the recess to inhibit the formation of a passage between the wall and the base plate when the wall is moved between the open and closed positions.

2. The system of claim 1, wherein the flange has a generally rectangular shape and the recess is configured such that at least two sides of the flange are disposed in sufficient close proximity to the recess to form a seal therewith.

3. The system of claim 1, wherein the flange has a generally rectangular shape and the recess is configured such that three sides of the flange are disposed in sufficient close proximity to the recess to form a seal therewith.

4. The system of claim 1, wherein the flange is disposed on the moveable wall and the flange cooperates with one or more surfaces on the base plate to form a labyrinth seal.

5. The system of claim 1, wherein the flange is positioned on an edge of the moveable wall adjacent to the impeller.

6. The system of claim 1, wherein the flange is positioned on an edge of the moveable wall but spaced from the impeller.

7. The system of claim 1, wherein a second flange projects outwardly from one of the moveable wall and base plate toward the other, the second flange cooperating with a second recess in the other to inhibit the formation of the passage between the wall and the base plate when the wall is moved between the open and closed positions.

8. The system of claim 7, wherein the first flange is disposed at or adjacent the edge of the moveable wall proximate the impeller and the second flange is disposed at or adjacent the edge of the wall proximate the outlet flow path.

9. The system of claim 2, wherein the base plate has a recess configured to receive the moveable wall and having side walls that are in sufficiently close proximity with the opposing inner and outer walls of the moveable wall to restrict the flow of fluid between the opposing surfaces when the wall is moved between the open and closed positions.

10. The system of claim 9 wherein the moveable wall and the base plate are configured so that the diffuser surface of the moveable wall aligns with the elongated surface of the base plate when the moveable wall is in the open position.

11. The system of claim 9, wherein the diffuser surface is angled, such that the width of the wall increases along the width of the diffuser.

12. The system of claim 1, wherein the moveable wall forms a ring encircling and axially aligned with the impeller.

13. The system of claim 1, wherein the moveable wall includes the recess and the flange projects from a face of the base plate toward the moveable wall.

14. A centrifugal compressor for compressing a fluid, comprising:

a housing;

an impeller rotatably mounted within the housing;

a base plate fixed to the housing adjacent the impeller, the base plate having an elongated surface that cooperates with an opposed interior surface on the housing to define an outlet flow path adjacent the outer radial surface of the impeller;

a moveable wall in the form of a ring disposed on the base plate and selectively moveable relative to the base plate, the wall having a diffuser surface disposed opposite the interior surface on the housing to define a diffuser positioned between the impeller and the outlet flow path, the wall being movable between an open position where the diffuser is maximized to a closed position where the diffuser is minimized;

wherein a flange projects outwardly from one of the moveable wall or the base plate toward a recess configured to receive the flange in the other, the flange cooperating with the recess to inhibit the formation of a passage between the wall and the base plate when the wall is moved between the open and closed positions.

15. The compressor of claim 14, wherein the flange has a generally rectangular shape and the recess is configured such that at least two sides of the flange are disposed in sufficient close proximity to the recess to form a seal therewith.

16. The compressor of claim 1, wherein the flange has a generally rectangular shape and the recess is configured such that three sides of the flange are disposed in sufficient close proximity to the recess to form a seal therewith.

17. The compressor of claim 14, wherein the flange is disposed on the moveable wall and cooperates with one or more surfaces in the base plate to form a labyrinth seal.

18. The compressor of claim 14, wherein the flange is positioned on an edge of the moveable wall adjacent to the impeller.

19. The compressor of claim 14, wherein the flange is positioned on an edge of the moveable wall but spaced from the impeller.

20. The compressor of claim 14, wherein a second flange projects outwardly from one of the moveable wall and base plate toward the other, the second flange cooperating with a second recess in the other to inhibit the formation of the passage between the wall and the base plate when the wall is moved between the open and closed positions.

21. The compressor of claim 20, wherein the first flange is disposed at or adjacent the edge of the moveable wall proximate the impeller and the second flange is disposed at or adjacent the edge of the wall proximate the outlet flow path.

22. The compressor of claim 14, wherein the base plate has a recess configured to receive the moveable wall and having side walls that are in sufficiently close proximity with the opposing inner and outer walls of the moveable wall to restrict the flow of fluid between the opposing surfaces when the wall is moved between the open and closed positions.

23. The compressor claim 22 wherein the moveable wall and the base plate are configured so that the diffuser surface of the moveable wall aligns with the elongated surface of the base plate when the moveable wall is in the open position.

24. The compressor of claim 14, wherein the diffuser surface is angled, such that the width of the wall increases along the width of the diffuser.

25. The compressor of claim 14, wherein the moveable wall includes the recess and the flange projects from a face of the base plate toward the moveable wall.

* * * * *

UNITED STATES PATENT AND TRADEMARK OFFICE

CERTIFICATE OF CORRECTION

PATENT NO. : 6,139,262

DATED : October 31, 2000

INVENTOR(S) : Ravi A. Ravindranath

It is certified that error appears in the above-identified patent and that said Letters Patent is hereby corrected as shown below:

Claim 9, col. 9, line 1, change "claim 2" to --claim 1--.

Claim 11, col. 9, line 11, change "claim 9" to --claim 1--.

Claim 16, col. 10, line 3, change "claim 1" to --claim 14--; and

Claim 16, col. 10, line 5, change "sufficient" to --sufficiently--.

Signed and Sealed this

Eighth Day of May, 2001

*Attest:*

Nicholas P. Godici

NICHOLAS P. GODICI

*Attesting Officer*

*Acting Director of the United States Patent and Trademark Office*